US005465761A

United States Patent [19]

Gheysen

[11] Patent Number: 5,465,761

[45] Date of Patent: Nov. 14, 1995

[54] SINGLE RAPIER WOVEN FACE-TO-FACE CARPET FABRIC IN ONE-SHOT-WEAVE

[75] Inventor: Nico Gheysen, Ledegem, Belgium

[73] Assignee: N.V. Michel Van de Wiele, Kortrijk-Marke, Belgium

[21] Appl. No.: 874,088

[22] Filed: Apr. 27, 1992

[30] Foreign Application Priority Data

May 21, 1991 [BE] Belgium ..... 09100477

[51] Int. Cl.[6] ..... D03D 27/10

[52] U.S. Cl. ..... 139/21; 139/398

[58] Field of Search ..... 139/21, 397, 398

[56] References Cited

U.S. PATENT DOCUMENTS 1,270,230 6/1918 Sohn ..... 139/397
3,519,032 7/1970 Sabbe ..... 139/398
4,756,340 7/1988 Janssen ..... 139/397

FOREIGN PATENT DOCUMENTS 0175963 4/1986 European Pat. Off. .

OTHER PUBLICATIONS

Zucker, "Comparison of Carpet Weaver", Melliand Textilberichte International, pp. 31–34 (Germany 1984) No Translation.

*Primary Examiner*—Andy Falik
*Attorney, Agent, or Firm*—James Creighton Wray

[57] ABSTRACT

A face-to-face carpet fabric is manufactured in a one shot-weave. A face-to-face pile fabric, more particularly a one shot-weave, is woven with single rapier or double rapier with weft elimination. The imposed working repeat for the pile warp ends goes over three picks. The working repeat of the backing fabric goes over a repeat different from that number of picks, preferably over four picks.

11 Claims, 14 Drawing Sheets

FIG. 1
PRIOR ART
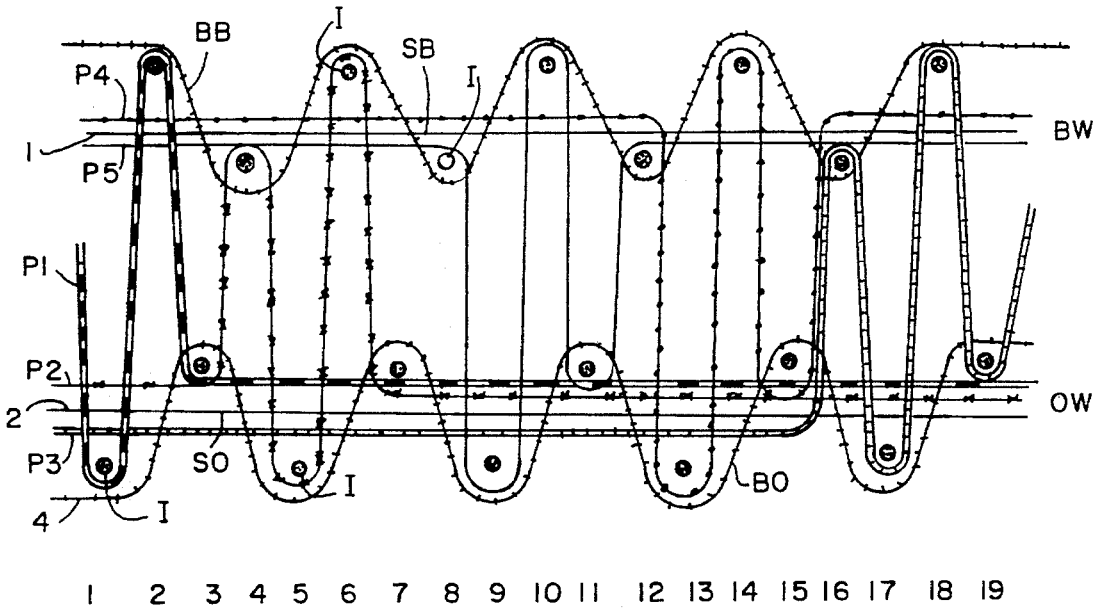
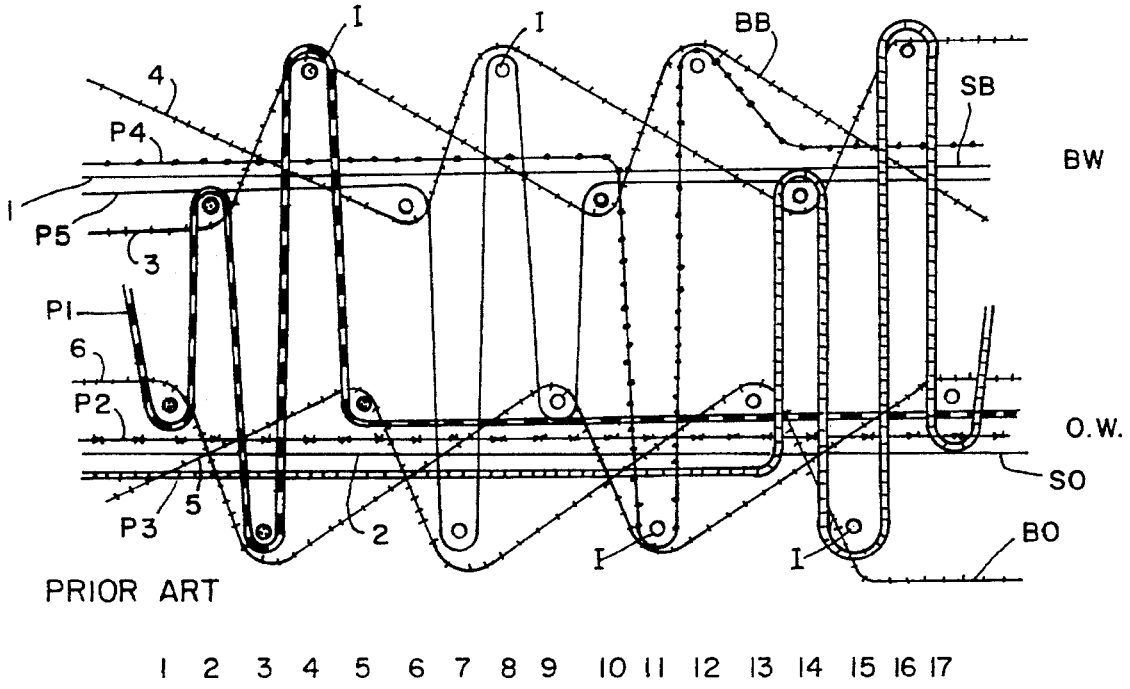
FIG. 2a

FIG. 4

| POINTED PAPER DRAWING | PRESENT PF IS | PREVIOUS REPEAT WAS | PF IN PREVIOUS REPEAT | TYPE OF PILE END IN BACKING REPEAT | BASIC REPEAT | LIFT PLAN |
|---|---|---|---|---|---|---|
| L | | | | | A | 1 |
| | | | | | B | 2 |
| | | | | | C | 3 |
| | | | | | D | 4 |
| PF | PFOW | L | | | A | 5 |
| | | | | | B | 6 |
| | | | | | C | 7 |
| | | | | | D | 8 |
| | | PF | SAME PILE END | | A | 9 |
| | | | | | B | 10 |
| | | | | | C | 11 |
| | | | | | D | 12 |
| | | | OTHER PILE END | PFOW | A | 13 |
| | | | | | B | 14 |
| | | | | | C | 15 |
| | | | | | D | 16 |
| | | | | PFBW | A | 17 |
| | | | | | B | 18 |
| | | | | | C | 19 |
| | | | | | D | 20 |
| | PFBW | L | | | A | 21 |
| | | | | | B | 22 |
| | | | | | C | 23 |
| | | | | | D | 24 |
| | | PF | SAME PILE END | | A | 25 |
| | | | | | B | 26 |
| | | | | | C | 27 |
| | | | | | D | 28 |
| | | | OTHER PILE END | PFOW | A | 29 |
| | | | | | B | 30 |
| | | | | | C | 31 |
| | | | | | D | 32 |
| | | | | PFBW | A | 33 |
| | | | | | B | 34 |
| | | | | | C | 35 |
| | | | | | D | 36 |

FIG. 5-1

| LIFT PLAN NUMBER | PICK NUMBER | WORKING PATTERN FORMING PILE (1) | WORKING PREVIOUS PATTERN FORMING PILE (2) | WORKING PIOW (4) IF NOT (1) OR (2) | WORKING PIBW (4) IF NOT (1) OR (2) |
|---|---|---|---|---|---|
| 1 | 1 | | | O | O |
| | 2 | | | O | B |
| | 3 | | | O | B |
| 2 | 1 | | | B | B |
| | 2 | | | O | O |
| | 3 | | | O | B |
| 3 | 1 | | | O | B |
| | 2 | | | B | B |
| | 3 | | | O | O |
| 4 | 1 | | | O | B |
| | 2 | | | O | B |
| | 3 | | | B | B |
| 5 | 1 | B | | O | O |
| | 2 | O | | O | B |
| | 3 | B | | O | B |

| LIFT PLAN NUMBER | PICK NUMBER | WORKING PATTERN FORMING PILE (1) | WORKING PREVIOUS PATTERN FORMING PILE (2) | WORKING PIOW (3) IF NOT (1) OR (2) | WORKING PIBW (4) IF NOT (1) OR (2) |
|---|---|---|---|---|---|
| 6 | 1 | O | | B | B |
| | 2 | B | | O | O |
| | 3 | O | | O | B |
| 7 | 1 | B | | O | B |
| | 2 | O | | B | B |
| | 3 | B | | O | O |
| 8 | 1 | O | | O | B |
| | 2 | B | | O | B |
| | 3 | O | | B | B |
| 9 | 1 | B | | O | O |
| | 2 | O | | O | B |
| | 3 | B | | O | B |
| 10 | 1 | O | | B | B |
| | 2 | B | | O | O |
| | 3 | O | | O | B |

FIG. 5-2

FIG. 5-3

| LIFT PLAN NUMBER | PICK NUMBER | WORKING PATTERN FORMING PILE (1) | WORKING PREVIOUS PATTERN FORMING PILE (2) | WORKING PIOW (3) IF NOT (1) OR (2) | WORKING PIBW (4) IF NOT (1) OR (2) |
|---|---|---|---|---|---|
| 11 | 1 | B | X | O | B |
| | 2 | O | X | B | B |
| | 3 | B | X | O | O |
| 12 | 1 | O | X | O | B |
| | 2 | B | X | O | B |
| | 3 | O | X | B | B |
| 13 | 1 | O | B | O | O |
| | 2 | O | O | O | B |
| | 3 | B | O | O | B |
| 14 | 1 | O | O | B | B |
| | 2 | B | O | O | O |
| | 3 | O | O | O | B |
| 15 | 1 | B | O | O | B |
| | 2 | O | B | B | B |
| | 3 | B | O | O | O |

FIG. 5-4

| LIFT PLAN NUMBER | PICK NUMBER | WORKING PATTERN FORMING PILE (1) | WORKING PREVIOUS PATTERN FORMING PILE (2) | WORKING PIOW (3) IF NOT (1) OR (2) | WORKING PIBW (4) IF NOT (1) OR (2) |
|---|---|---|---|---|---|
| 16 | 1 | O | O | O | B |
| | 2 | B | O | O | B |
| | 3 | O | B | B | B |
| 17 | 1 | O | B | O | O |
| | 2 | O | B | O | B |
| | 3 | B | B | O | B |
| 18 | 1 | O | B | B | B |
| | 2 | B | O | O | O |
| | 3 | O | B | O | B |
| 19 | 1 | O | B | O | B |
| | 2 | O | B | B | B |
| | 3 | B | O | O | O |
| 20 | 1 | O | B | O | B |
| | 2 | B | B | O | B |
| | 3 | O | B | B | B |

FIG. 5-5

| LIFT PLAN NUMBER | PICK NUMBER | WORKING PATTERN FORMING PILE (1) | WORKING PREVIOUS PATTERN FORMING PILE (2) | WORKING PIOW (3) IF NOT (1) OR (2) | WORKING PIBW (4) IF NOT (1) OR (2) |
|---|---|---|---|---|---|
| 21 | 1 | B | X | O | O |
| | 2 | O | X | O | B |
| | 3 | B | X | O | B |
| 22 | 1 | O | X | B | B |
| | 2 | B | X | O | O |
| | 3 | O | X | O | B |
| 23 | 1 | B | X | O | B |
| | 2 | O | X | B | B |
| | 3 | B | X | O | O |
| 24 | 1 | O | X | O | B |
| | 2 | B | X | O | B |
| | 3 | O | X | B | B |
| 25 | 1 | B | X | O | O |
| | 2 | O | X | O | B |
| | 3 | B | X | O | B |

FIG. 5-6

| LIFT PLAN NUMBER | PICK NUMBER | WORKING PATTERN FORMING PILE (1) | WORKING PREVIOUS PATTERN FORMING PILE (2) | WORKING PIOW (3) IF NOT (1) OR (2) | WORKING PIBW (4) IF NOT (1) OR (2) |
|---|---|---|---|---|---|
| 26 | 1 | O | | B | B |
| | 2 | B | | O | O |
| | 3 | O | | O | B |
| 27 | 1 | B | | O | B |
| | 2 | O | | B | B |
| | 3 | B | | O | O |
| 28 | 1 | O | | O | B |
| | 2 | B | | O | B |
| | 3 | O | | B | B |
| 29 | 1 | B | O | O | O |
| | 2 | O | O | O | B |
| | 3 | B | O | O | B |
| 30 | 1 | B | O | B | B |
| | 2 | B | O | O | O |
| | 3 | O | O | O | B |

FIG. 5-7

| LIFT PLAN NUMBER | PICK NUMBER | WORKING PATTERN FORMING PILE (1) | WORKING PREVIOUS PATTERN FORMING PILE (2) | WORKING PIOW (3) IF NOT (1) OR (2) | WORKING PIBW (4) IF NOT (1) OR (2) |
|---|---|---|---|---|---|
| 31 | 1 | B | O | O | B |
| | 2 | O | B | B | B |
| | 3 | B | O | O | O |
| 32 | 1 | B | O | O | B |
| | 2 | B | O | O | B |
| | 3 | O | B | B | B |
| 33 | 1 | B | B | O | O |
| | 2 | O | B | O | B |
| | 3 | B | B | O | B |
| 34 | 1 | O | B | B | B |
| | 2 | B | O | O | O |
| | 3 | O | B | O | B |
| 35 | 1 | B | B | O | B |
| | 2 | O | B | B | B |
| | 3 | B | O | O | O |

FIG. 5-8

| LIFT PLAN NUMBER | PICK NUMBER | WORKING PATTERN FORMING PILE (1) | WORKING PREVIOUS PATTERN FORMING PILE (2) | WORKING PIOW (3) IF NOT (1) OR (2) | WORKING PIBW (4) IF NOT (1) OR (2) |
|---|---|---|---|---|---|
| 36 | 1 | B | O | O | B |
| | 2 | B | B | O | B |
| | 3 | O | B | B | B |
| | 1 | | | | |
| | 2 | | | | |
| | 3 | | | | |
| | 1 | | | | |
| | 2 | | | | |
| | 3 | | | | |
| | 1 | | | | |
| | 2 | | | | |
| | 3 | | | | |
| | 1 | | | | |
| | 2 | | | | |
| | 3 | | | | |

SINGLE RAPIER WOVEN FACE-TO-FACE CARPET FABRIC IN ONE-SHOT-WEAVE

The invention relates to a method for the manufacture of face-to-face woven carpets, whereby the pattern is formed by the so-called pile warp ends, which run from the upper fabric to the lower fabric and vice versa, and which are distinguished in working or pattern forming pile, when the pile ends run from one fabric to the other, while the non-working pile ends are referred to as dead pile.

The invention more especially relates to a method for weaving on a single rapier weaving machine, or double rapier weaving machine with weft elimination in a face-to-face fabric according to the single shuttle weave.

BACKGROUND OF THE INVENTION

The state of the art is illustrated on the basis of FIG. 1 attached hereto, which schematically represents a single shuttle weave of a face-to-face fabric. For the weaving of a face-to-face carpet fabric according to the single shuttle weaving principle, a weft end (1) is alternately inserted in the lower fabric (OW) and in the upper fabric (BW). The first pick locates the weft (1) under the tight warp end (SO) of the lower fabric (OW). With the next pick the weft (1) is located above the tight warp end (SB) of the upper fabric. With the next pick the weft (1) is located above the tight warp end (SO) of the lower fabric (OW). The following pick locates the weft (1) under the tight warp end (SB) of the upper fabric (BW).

In order to weave the weft (1) to the tight warps SO and SB, one or more binding warps are added.

There are various known manners for interlacing these binding warps. The backing fabric is repeated every 4 picks, as is the case with the example in FIG. 1—when the backing fabric on pick 1-2-3-4 is repeated on pick 5-6-7-8, on pick 9-10-11-12, etc.

The numbering of each pick starts from the extreme left weft—consisting of a weft end (1) inserted in OW—which is referred to as pick 1, while following the fabric from left to right in FIG. 1, the successive wefts are referred to in sequence as pick 2, pick 3, etc. . . . The numbering is indicated vertically under each weft in the figure. The pile warp ends are indicated as P1, P2, P3, P4, P5.

These pile warp ends can take up 2 positions in relation to the rapier or in relation to the weft.

When the pile warp ends make no connection between the lower fabric (OW) and the upper fabric (BW), that pile warp end acts as dead pile, this pile warp end participates in the weave of OW, respectively BW, and relates to it as a woven-in pile warp end, or simply of a woven-in dead pile.

According to the state of the art the choice is made between remaining either woven-in, or to connect the fabrics e.g. OW resp. BW with the other BW resp. OW as working or pattern forming pile warp end after pick 2. When a pile warp—for example P1—acts as working pile in pick 1, this end P1 is lowered under the weft, while the other pile warp ends are raised above the weft. On pick 2 the pile warp end P1 will then be raised above the weft while the other pile warp ends are lowered under the weft. Color change should take place after pick 2 with P2 also woven into the lower piece. On pick 3 the working pile P2 will then first be lowered under the weft together with the woven-in pile warp ends (to which P1 now also belongs) of the lower carpet. Pile warp ends which are woven into the upper carpet are raised above pick 3. On pick 4 P2 is now raised above the weft I, woven into the upper fabric together with the colors. Colors woven into the lower fabric are below. The single shuttle weave is obtained according to this technique.

This single shuttle weave has the disadvantage that it shows so-called double workers. With the change over from a certain color formed by a pattern forming pile warp end which after this change over is woven into the upper fabric to another color formed by a pattern forming pile warp end which was woven into the lower fabric for this change over, a tuft runs from the ending color P4 together with the starting color P3 (see picks 15 and 16 in FIG. 1). These pile tufts of different color will be placed next to each other (in weft direction) and they are referred to as double workers. The separation line between these two color fields is unclear and shows a certain saw-tooth line.

From EP 175 963 it is known that in order to avoid these double workers the demarcation between the color fields can be improved by lowering the pile which is starting to be pattern forming (e.g. on pick 16—FIG. 1) under a weft. Because of this however a pile loop is eliminated. With this method a color point is made in the pointed-paper drawing per 4 picks (2 picks per carpet), because the weaving-in shows a repeat over pick 4.

For a pattern resolution of e.g. 4 rows/cm in the pointed-paper drawing 8 picks/cm must be made in the carpet.

SUMMARY OF THE INVENTION

The object of the invention is a method for weaving a face-to-face pile fabric, more especially a 1 shot-weave according to the single shuttle weaving process or double shuttle weaving process with weft elimination with the purpose of avoiding the double workers, combined with a pattern resolution of 1.5 picks per carpet per color point in the pointed-paper drawing.

The method according to the invention for the manufacture of a face-to-face carpet fabric more especially in a single shuttle weave consists in imposing a working repeat of 3 picks for the pile warp ends (1.5 picks per carpet), while the working repeat of the backing fabric is effected over 4 picks (2 picks per carpet).

More details and advantages of the method according to the invention will appear from the following description of a method according to the invention with the assistance of the attached figures and tables.

BRIEF DESCRIPTION OF THE DRAWINGS

FIG. 1 is a schematic representation of a face-to-face single shuttle one shot-weave with double workers.

FIG. 2*a* is a schematic representation of a face-to-face single shuttle one shot-weave without double workers, with a pattern resolution of 2 picks per carpet as described in the European Patent 175.963.

FIG. 4 is the representation of a decision plan for the choice of a lift plan.

FIG. 5 are tables regarding the correspondence between the lift plans used and the desired positions of the pile warp ends.

DETAILED DESCRIPTION OF THE DRAWINGS

Figure 2B:
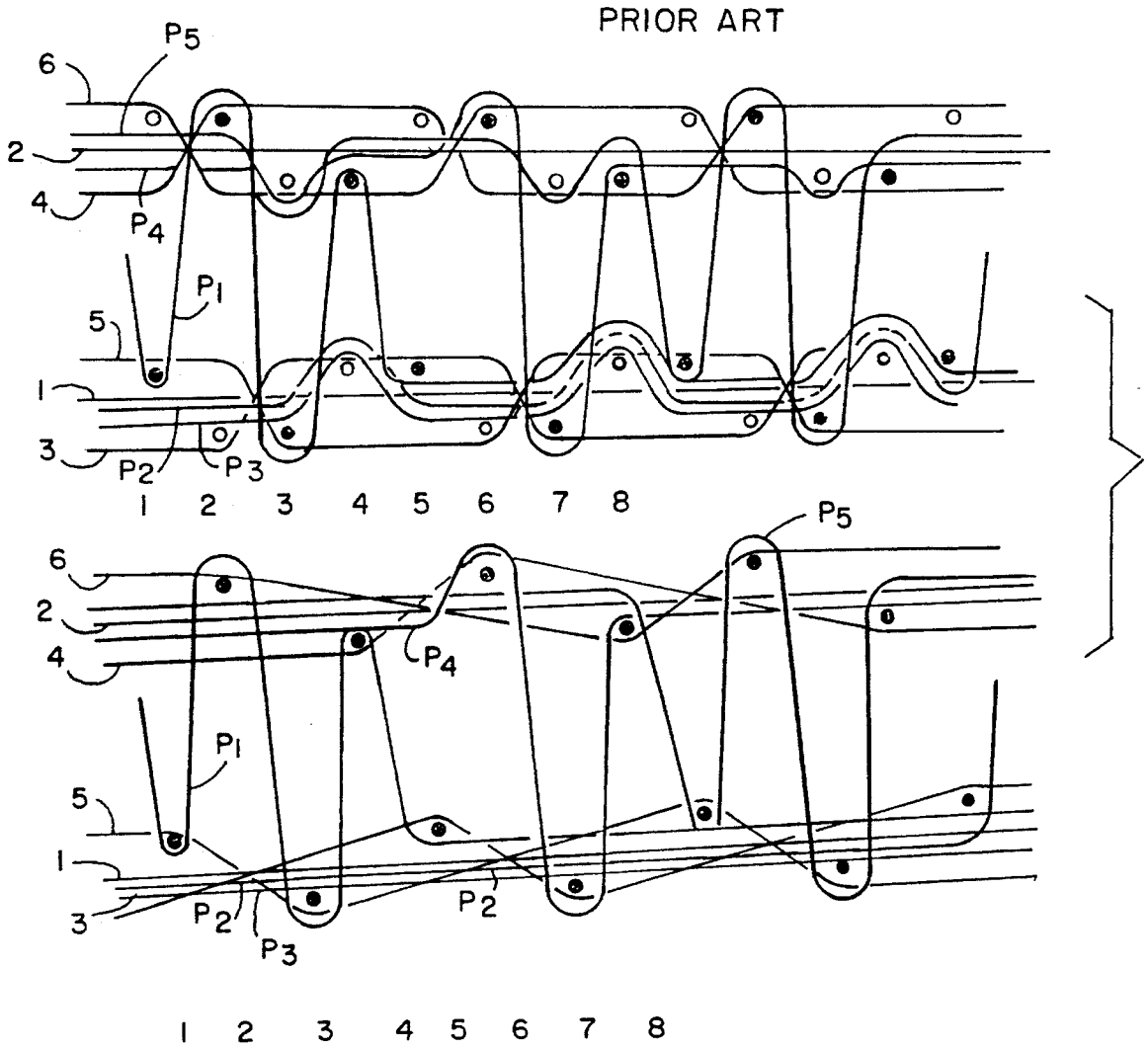
FIG. 2*b* is a schematic representation of a face-to-face double shuttle woven one shot-weave with weft elimination, without double workers, with a pattern resolution of 2 picks per carpet.
Figure 3A:
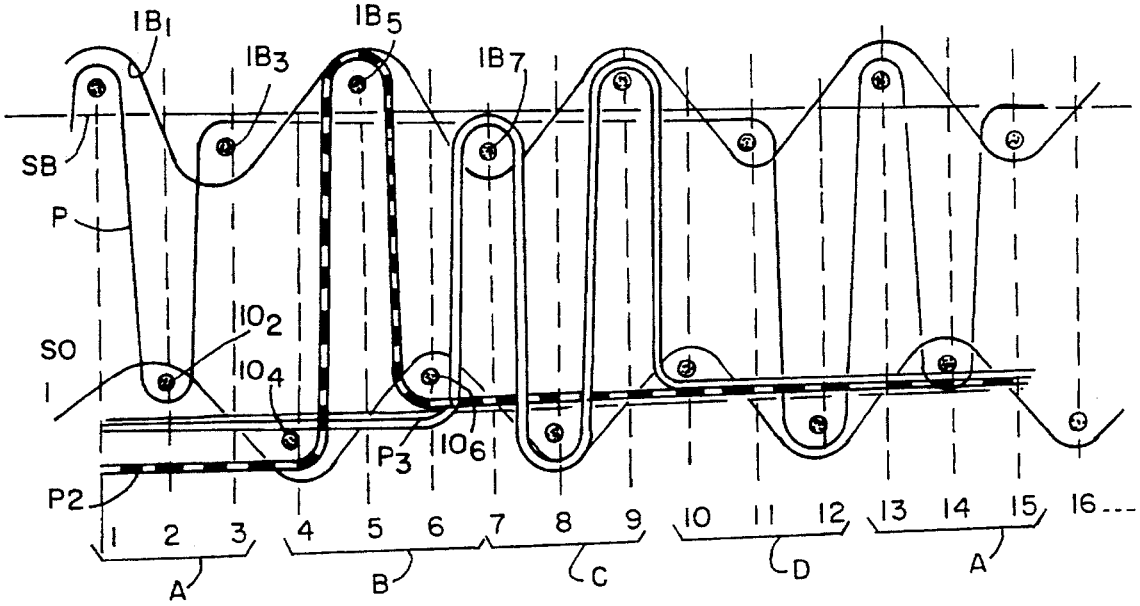
FIG. 3*a* is a schematic representation of a face-to-face single shuttle woven one shot-weave according to the invention.
Figure 3B:
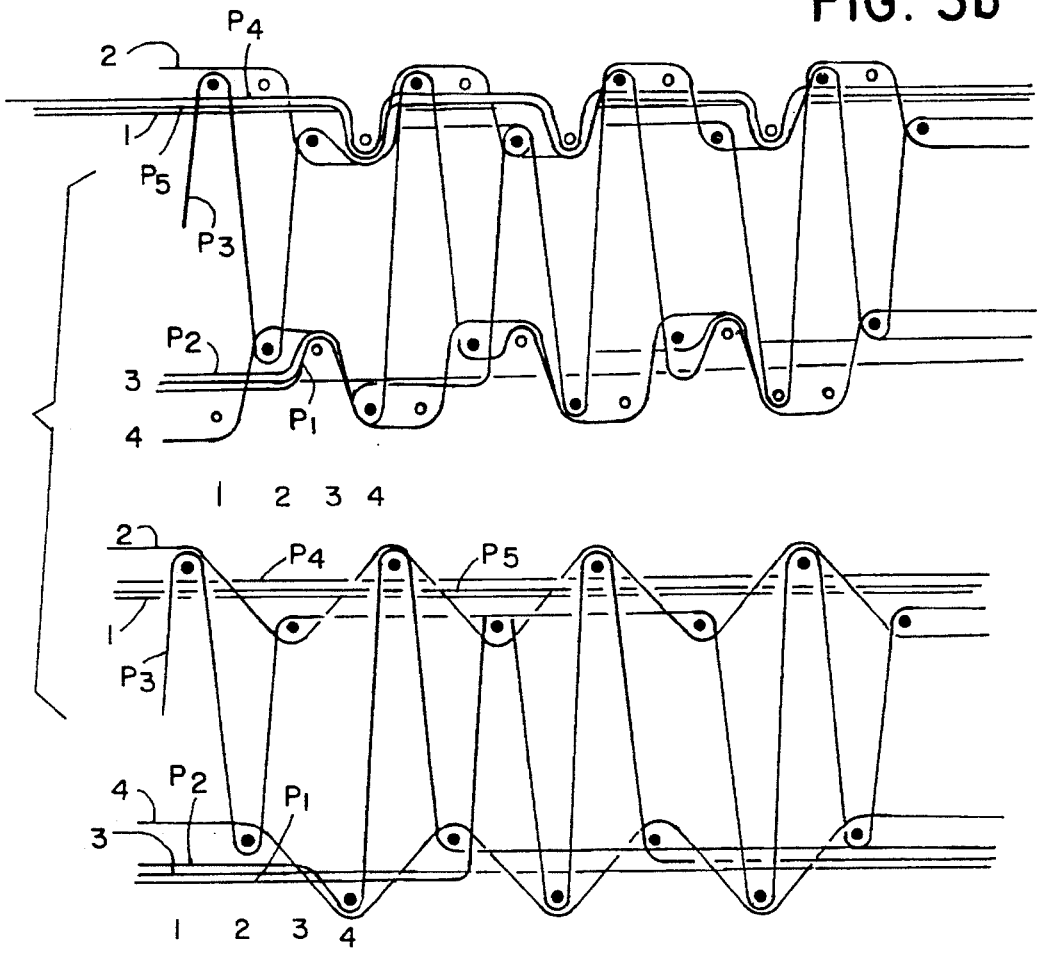
FIG. 3*b* is a schematic representation of a face-to-face double shuttle woven one shot-weave with weft elimination according to the invention.

With a face-to-face pile fabric according to a single shuttle woven one shot-weave, of which the weave is represented in FIG. 3*a*, or a double shuttle woven one shot-weave with weft elimination, of which the weave is represented in FIG. 3*b*, a weft is alternately inserted in the upper fabric (BW) and the lower fabric (OW).

With each odd pick (1, 3, 5, . . . ) the weft (IB1, IB2, . . . ) is in the upper fabric. On picks 1, 5, 9, 13, . . . the weft is above the tight warp (SB) while on picks 3, 7, 11, . . . the weft is under the tight warp (SB).

With each even pick (2, 4, 6, . . . ) the weft (I02, I04, . . . ) is in the lower fabric. On picks 2, 6, 10, 14, . . . the weft (I02, I06, I010, . . . ) is above the tight warp (SO) while on picks (4, 8, 12, . . . ) the weft (I04, I08, I012, . . . ) is under the tight warp.

The manner in which these wefts are interlaced by means of the binder warp is known and occurs under a repeat of 4 picks.

On the other hand with the method according to the invention a working repeat for the pile warp ends is imposed over 3 picks (1.5 picks per carpet): this working repeat is specified for the pattern forming (PF) pile warp ends, for the pile warp ends woven into the upper fabric (PIBW) and woven into the lower fabric (PIOW).

In the case of a 3 frame fabric, as represented in FIG. 3*a*, pile warp end (P1) is pattern forming with picks (1, 2, 3), and woven into the upper fabric on picks (4, 5, 6), (7, 8, 9), . . . ; pile warp end (P2) is woven into the lower fabric with picks (1, 2, 3) and pattern forming with picks (4, 5, 6) and again woven into the lower fabric with picks (7, 8, 9, 10, 11, 12 . . . ); pile warp end (P3) is woven into the lower fabric on picks (1, 2, 3) and (4, 5, 6) and pattern forming with picks (7, 8, 9) and again woven into the lower fabric on picks (10, 11, 12). On the pointed-paper drawing 1 color point is obtained per 3 picks in total, or per 1.5 picks in the carpet, while the working repeat for the pile warp ends runs over three picks subsequently with a repeat A, B, C and D for interlacing in the backing fabric, whereby these repeats differ from each other, in the sequence of the picks, by the location of the weft ends above (B) or under (O) the tight warp ends of the upper fabric (BW) or of the lower fabric (OW) in the following manner.

Repeat A shows B/BW—B/0W—O/BW then B shows O/OW—B/BW—B/OW then C shows O/BW—O/OW—B/BW and D shows B/OW—O/BW—0/OW The position of the pile warp ends to be taken up in a specific working repeat is dependent upon the position of the pile warp ends during the previous repeat, either in a pattern forming pile, or woven-in, or in the working repeat A, B, C or D.

The various possibilities are collected in FIG. 4. This table can be used for the choice of the correct lift plan. The following abbreviations are used:

PF: pattern forming pile warp end

L : linen (woven-in pile warp end)

OW: lower fabric

BW: upper fabric

According to the desired method the binding lift plans to be used are indicated in FIG. 5 together with the respective positions for the pile warp ends.

With each 2 picks of the backing fabric (1 pick per carpet) a pile loop with at least one tuft is formed on the lower fabric (OW) as well as on the upper fabric (BW). Only a pile loop is missing (see picks 3, 4 and 5 and picks 10, 11 in FIG. 3*a*) of a pattern forming pile warp end, in the change over from a pattern forming pile which is woven into the upper fabric while the new pattern forming pile was woven into the lower fabric instead, and also in the change over from a pattern forming pile which is woven-in in the lower fabric while the new figure forming pile was woven into the upper fabric instead, and this for all working repeats A, B, C and D.

In the weave according to the method according to the invention as represented in FIG. 3*a*, we have:

on picks (1, 2, 3) the pattern forming pile warp end is (P1) which belongs to the pile wrap ends to be woven-in in the upper fabric (BW), whereby the previous working repeat was not pattern forming (linen), and now the working repeat A and therefore lift plan (21) should be used (see table from FIG. 4).

on picks (4, 5, 6) the pattern forming pile warp end is (P2) which belongs to the pile wrap ends to be woven-in in the lower fabric (OW). The previous repeat was pile forming, but with another pile warp end which was expected to be woven-in in the upper fabric, and the actual working repeat is B. Then lift plan (18) should be used (see FIG. 4). No double worker appears between picks 2 and 3.

on picks (7, 8, 9) the pattern forming pile warp end is (P3) which belongs to the pile wrap ends to be woven-in in the lower fabric, while the previous repeat was pile forming, but with another pile warp end which was expected to be woven-in in the lower fabric, and working repeat C is actual now for which purpose lift plan (15) should then be used (see FIG. 4).

The pattern forming pile is the pile which extends between the upper weave and the lower weave and which gives the fabric its color tufts when the piles are cut to show the colors.

on picks (10, 11 12) the pattern forming pile warp end is (P1) which belongs to the pile wrap ends to be woven-in in the upper fabric, while the previous working repeat was also pattern forming with another pile end which is expected to be woven-in in the lower fabric, now the working repeat D is actual for which purpose lift plan (32) should then be used (see FIG. 4).

on picks (13, 14, 15) the pattern forming pile end is (P1) which belongs to the pile wrap ends to be woven-in in the upper fabric, while the previous working repeat was also pattern forming with the same pile end and the working repeat A is actual so that lift plan 25 should be used (see FIG. 4).

In FIG. 5 attached hereto the different positions of the different warp ends for each lift plan are then represented in table form.

For the weave from FIG. 3*a* the lift plans 21, 18, 15, 32 and 25 are successively to be used. The lift plans are chosen according to the desired colored piles to be extended between the upper weave BW and the lower weave OW. It can be seen in the table from FIG. 5 that for the pattern forming pile warp end the successive positions are: above—below—above/below— above—below/above—below—above/above—above —below/above—below—above. This indeed corresponds with the positions of successive pile warp end (P1) ( for picks 1, 2, 3 ), pile warp end (P2) ( for picks 4, 5, 6), pile warp end (P3) (for picks 7, 8, 9), pile warp end (P1) (for picks 10, 11, 12, 13, 14, 15), as the schematic representation of the desired weave represents in FIG. 3*a*.

In FIG. 5 the positions of the other pile warp ends can also be read in the same manner, they correspond to the various lift plans. The other possible pile warp ends (see table from FIG. 5) are: the preceding figure forming pile; the pile warp end which is woven-in in the lower fabric (PIOW), if this is not the present of the preceding figure forming pile warp end, the pile warp end which is woven into the upper fabric (PIBW), if this is not the present of the preceding figure forming pile warp end.

Figure 6A:
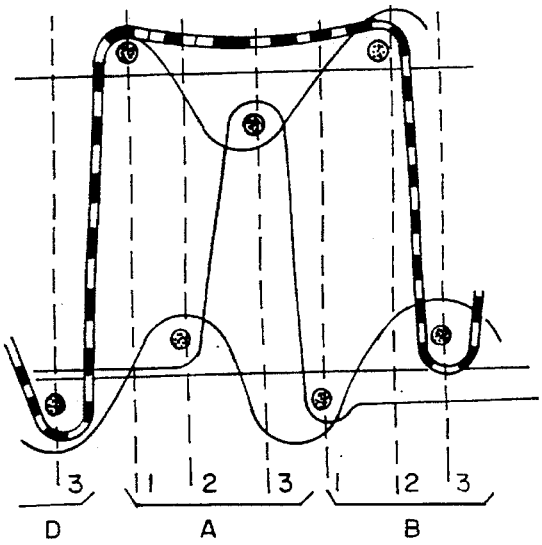
FIG. 6*a* is a schematic representation of a certain situation whereby a non pattern forming pile warp end is raised above the upper fabric on an intermediate weaving repeat where that pile end was working before and is becoming working after.

If a pile warp end which belongs to the ones to be woven-in in the upper fabric on repeat D is pattern forming (FIG. 6*a*) and this same pile warp end is again figure forming on the subsequent weave repeat B, with a pile warp end which belongs to the ones to be woven-in in the lower fabric on repeat A is pattern forming there between, then according to the above described technique, which applies the suitable lift plan dependent upon the present whether or not pattern forming pile end belonging to the ones to be woven-in in the lower or upper fabric, dependent upon the preceding whether or not pattern forming pile warp end belonging to the ones to be woven-in in the lower or upper fabric and dependent upon the weave repeat A, B, C or D will result in the pile warp end which is on the weave repeat D and B will not be woven in on picks 1, 2 and 3 of the intermediate weave repeat A, but will float above the upper fabric.

Figure 6B:
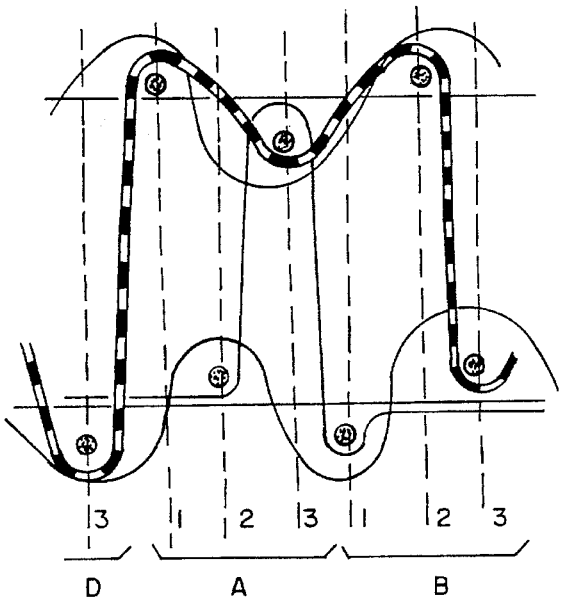
FIG. 6*b* is a schematic representation of the preceding situation whereby the non-pattern forming pile warp end in question is woven-in on to an intermediate weaving repeat, but under the third weft of this repeat.

The solution to this fault is represented in FIG. 6*b* for the woven-in pile which floats above the upper fabric in weave repeat A. The woven-in pile will be woven in by lowering it under pick 3 of the weave repeat A. This is systematically solved as follows: after the application of the different lift plans described in FIG. 5 the weave obtained is checked for the appearance of pile warp ends floating over five successive picks. With a float over five successive picks the end is lowered at the third pick whereby the pile warp end in question is thus lowered under the third weft and in this way is woven in.

Figure 6C:
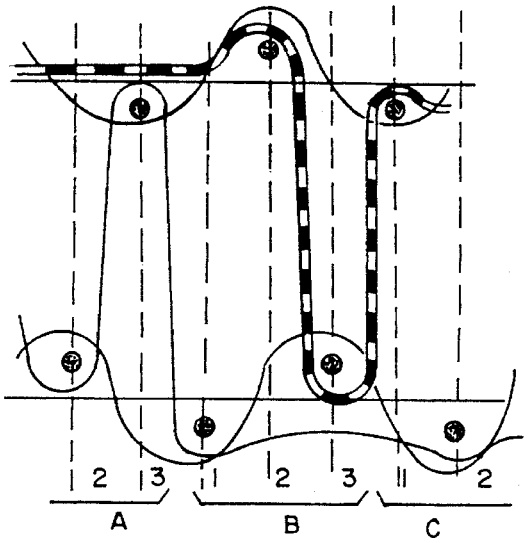
FIG. 6*c* is a schematic representation of a corresponding situation for lower fabric, as represented in figure a for upper fabric.

If the pile warp end which belongs to the ones to be woven-in in the lower fabric on repeat A is pattern forming and this same pile warp end is again pattern forming on the subsequent weave repeat C, with a pile warp end which is belonging to the ones to be woven into the upper work on repeat B is pattern forming there between, then with the application of the above described technique this will result in the pile warp end which is on the weave repeat A and C will not be woven-in on picks 1, 2 and 3 of the intermediate weave repeat B, but will float under the lower fabric (see FIG. 6*c*).

Figure 6D:
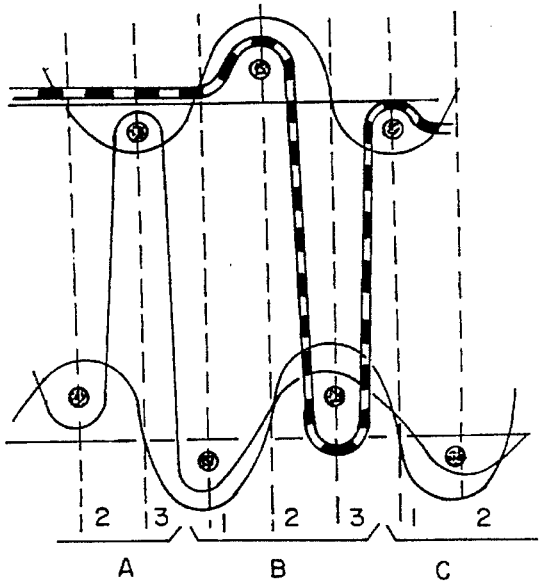
FIG. 6*d* is a schematic representation of a corresponding solution with the lower fabric to that represented in figure b for upper fabric.

The solution to this fault is represented in FIG. 6*d* for the woven-in pile which floats under the lower fabric in weave repeat B. The woven-in pile will be woven-in by raising it above pick 3 of the weave repeat B. This is systematically solved as follows: after the application of the different lift plans described in FIG. 5 the weave obtained is checked for the appearance of pile warp ends floating under the weft on 5 successive picks. With a float under these 5 successive picks the end is raised on the third pick of these 5 whereby the pile warp end in question is thus raised above the third weft and in this way is woven-in.

Figure 7:
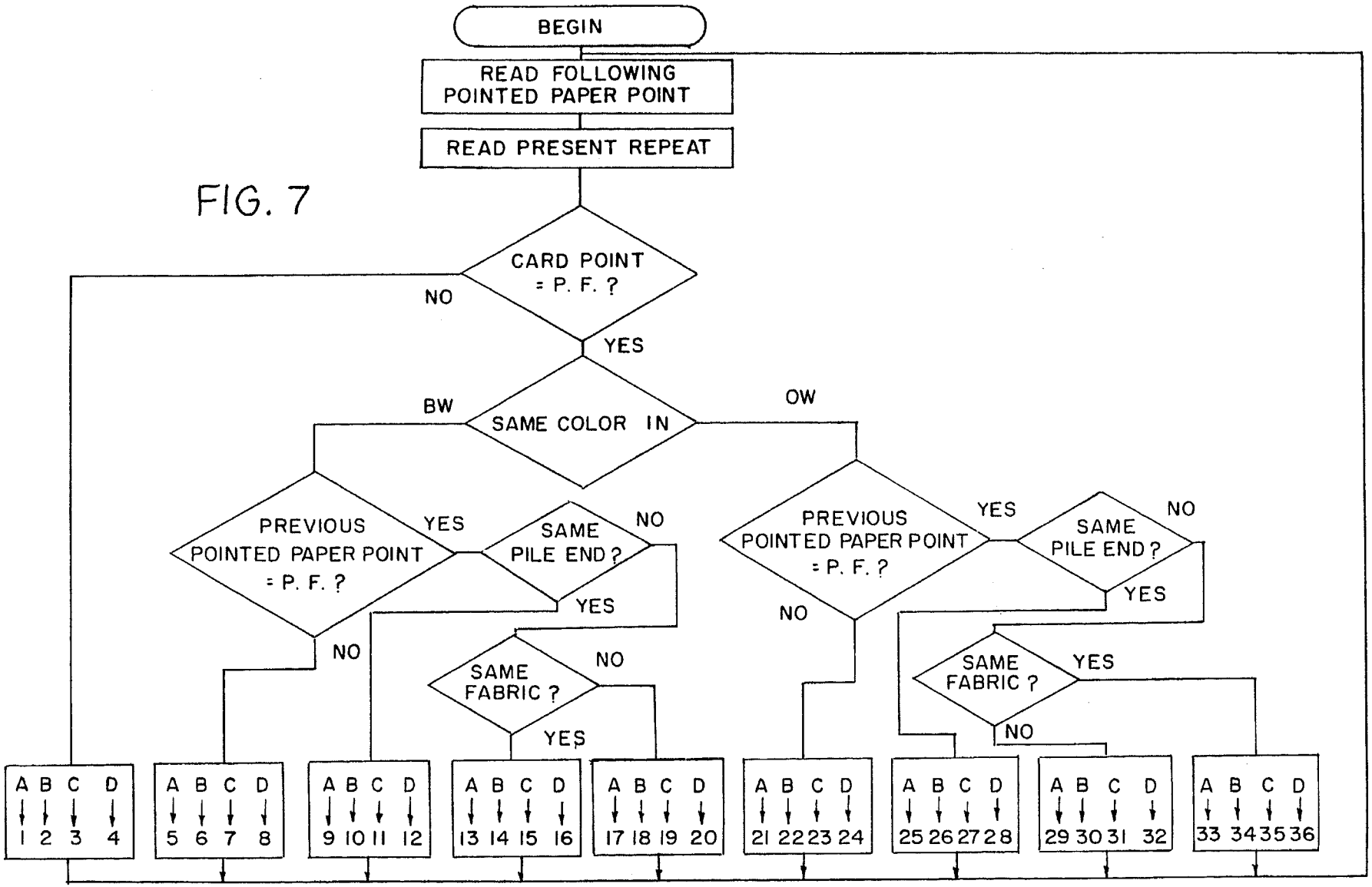
FIG. 7 is a flow chart for the choice of the lift plans.

Finally it ends up as represented in FIG. 7 in a succession of questions with regard to the position of the pile warp ends and the weave repeat in question which leads to the choice of the lift plan.

The advantage of the method according to the invention, in general consists of the fact that double workers no longer appear in the 2 face-to-face one-shot fabrics manufactured, while the pattern resolution is increased and whereby one and the same weaving speed can be maintained as before.

An arbitrary repeat of 6 picks (3 picks per fabric) with change over from PFOW to PFOW is identified by 3 pile loops per 6 picks both in the lower fabric and in the upper fabric.

An arbitrary repeat of 6 picks (3 picks per fabric) with change over from PFOW to PFBW is identified by 2 pile loops per 6 picks both in the lower fabric and in the upper fabric.

An arbitrary repeat of 6 picks (3 picks per fabric) with change over from PFBW to PFBW is identified by 3 pile loops per 6 picks both in the lower fabric and in the upper fabric.

An arbitrary repeat of 6 picks with change over from PFBW to PFOW is identified by 2 pile loops both in the lower fabric and in the upper fabric.

The number of color points in the pointed-paper drawing of the carpet is equal to a third of the total number of picks and therefore equal to the number of picks per carpet divided by 1.5.

I claim:

1. Method for weaving a face-to-face pile fabric, with a one shot-weave, woven with single rapier or double rapier with weft elimination, where a lower and an upper backing fabric are formed by successively inserting a weft end (I)—each insertion being called a pick—alternately on an upper and a lower level, to form a weft with plural tight warp ends (SB), (SO) and plural binding warp ends, extending on the upper and the lower levels, whereas positions of the weft ends in relation to the tight warp ends are repeated after a number of picks, called a working repeat, and where at least one pile warp end is alternately woven-in into the upper and the lower backing fabric, the position in relation to the wefts each time being imposed for an equal number of successive picks, called the imposed working repeat, characterized in that the imposed working repeat for the pile warp ends only goes over three picks, while the working repeat of the backing fabric goes over a repeat length different from 3 picks, over four picks.

2. Method according to claim 1 characterized in that the working repeat—over three picks—for each pile warp end is defined by a lift plan, which determines on every pick the position of that pile warp end.

3. Method according to claim 1, characterized in that 36 lift plans are available in order to define the successive positions with the pile warp end, in a working repeat over 3 picks, namely: whereby the pattern forming pile end in the working repeat is indicated by the number 1; the pattern forming pile end in the preceding repeat is indicated by the number 2; the pile end which is woven into the lower fabric (and is neither 1, nor 2) is indicated by the number 3; the pile end which is woven into the upper fabric (and is neither 1, nor 2) is indicated by the number 4 and whereby with the positions below and above for these pile warp ends is meant that these are respectively under the weft end and above the weft end and whereby these positions are abbreviated respectively as O and B:

| | | |
|---|---|---|
| Lift plan 1: | pile end 1: | does not occur |
| | pile end 2: | does not occur |
| | pile end 3: | 0 - 0 - 0 |
| | pile end 4: | 0 - B - B |
| Lift plan 2: | pile end 1: | does not occur |
| | pile end 2: | does not occur |
| | pile end 3: | B - 0 - 0 |
| | pile end 4: | B - 0 - B |
| Lift plan 3: | pile end 1: | does not occur |
| | pile end 2: | does not occur |
| | pile end 3: | 0 - B - 0 |
| | pile end 4: | B - B - 0 |
| Lift plan 4: | pile end 1: | does not occur |
| | pile end 2: | does not occur |
| | pile end 3: | 0 - 0 - B |
| | pile end 4: | B - B - B |
| Lift plan 5: | pile end 1: | B - 0 - B |
| | pile end 2: | does not occur |
| | pile end 3: | 0 - 0 - 0 |
| | pile end 4: | 0 - B - B |
| Lift plan 6: | pile end 1: | 0 - B - 0 |
| | pile end 2: | does not occur |
| | pile end 3: | B - 0 - 0 |
| | pile end 4: | B - 0 - B |
| Lift plan 7: | pile end 1: | B - 0 - B |
| | pile end 2: | does not occur |
| | pile end 3: | 0 - B - 0 |
| | pile end 4: | B - B - 0 |
| Lift plan 8: | pile end 1: | 0 - B - 0 |
| | pile end 2: | does not occur |
| | pile end 3: | 0 - 0 - B |
| | pile end 4: | B - B - B |
| Lift plan 9: | pile end 1: | B - 0 - B |
| | pile end 2: | does not occur |
| | pile end 3: | 0 - 0 - 0 |
| | pile end 4: | 0 - B - B |
| Lift plan 10: | pile end 1: | 0 - B - 0 |
| | pile end 2: | does not occur |
| | pile end 3: | B - 0 - 0 |
| | pile end 4: | B - 0 - B |
| Lift plan 11: | pile end 1: | B - 0 - B |
| | pile end 2: | does not occur |
| | pile end 3: | 0 - B - 0 |
| | pile end 4: | B - B - 0 |
| Lift plan 12: | pile end 1: | 0 - B - 0 |
| | pile end 2: | does not occur |
| | pile end 3: | 0 - 0 - B |
| | pile end 4: | B - B - B |
| Lift plan 13: | pile end 1: | 0 - 0 - B |
| | pile end 2: | B - 0 - 0 |
| | pile end 3: | 0 - 0 - 0 |
| | pile end 4: | 0 - B - B |
| Lift plan 14: | pile end 1: | 0 - B - 0 |
| | pile end 2: | 0 - 0 - 0 |
| | pile end 3: | B - 0 - 0 |
| | pile end 4: | B - 0 - B |
| Lift plan 15: | pile end 1: | B - 0 - B |
| | pile end 2: | 0 - B - 0 |
| | pile end 3: | 0 - B - 0 |
| | pile end 4: | B - B - 0 |
| Lift plan 16: | pile end 1: | 0 - B - 0 |
| | pile end 2: | 0 - 0 - B |
| | pile end 3: | 0 - 0 - B |
| | pile end 4: | B - B - B |
| Lift plan 17: | pile end 1: | 0 - 0 - B |
| | pile end 2: | B - B - B |
| | pile end 3: | 0 - 0 - 0 |
| | pile end 4: | 0 - B - B |
| Lift plan 18: | pile end 1: | 0 - B - 0 |
| | pile end 2: | B - 0 - B |

-continued

| | | |
|---|---|---|
| | pile end 3: | B - 0 - 0 |
| | pile end 4: | B - 0 - B |
| Lift plan 19: | pile end 1: | 0 - 0 - B |
| | pile end 2: | B - B - 0 |
| | pile end 3: | 0 - B - 0 |
| | pile end 4: | B - B - 0 |
| Lift plan 20: | pile end 1: | 0 - B - 0 |
| | pile end 2: | B - B - B |
| | pile end 3: | 0 - 0 - B |
| | pile end 4: | B - B - B |
| Lift plan 21: | pile end 1: | B - 0 - B |
| | pile end 2: | does not occur |
| | pile end 3: | 0 - 0 - 0 |
| | pile end 4: | 0 - B - B |
| Lift plan 22: | pile end 1: | 0 - B - 0 |
| | pile end 2: | does not occur |
| | pile end 3: | B - 0 - 0 |
| | pile end 4: | B - 0 - B |
| Lift plan 23: | pile end 1: | B - 0 - B |
| | pile end 2: | does not occur |
| | pile end 3: | 0 - B - 0 |
| | pile end 4: | B - B - 0 |
| Lift plan 24: | pile end 1: | 0 - B - 0 |
| | pile end 2: | does not occur |
| | pile end 3: | 0 - 0 - B |
| | pile end 4: | B - B - B |
| Lift plan 25: | pile end 1: | B - 0 - B |
| | pile end 2: | does not occur |
| | pile end 3: | 0 - 0 - 0 |
| | pile end 4: | 0 - B - B |
| Lift plan 26: | pile end 1: | 0 - B - 0 |
| | pile end 2: | does not occur |
| | pile end 3: | B - 0 - 0 |
| | pile end 4: | B - 0 - B |
| Lift plan 27: | pile end 1: | B - 0 - B |
| | pile end 2: | does not occur |
| | pile end 3: | 0 - B - 0 |
| | pile end 4: | B - B - 0 |
| Lift plan 28: | pile end 1: | 0 - B - 0 |
| | pile end 2: | does not occur |
| | pile end 3: | 0 - 0 - B |
| | pile end 4: | B - B - B |
| Lift plan 29: | pile end 1: | B - 0 - B |
| | pile end 2: | 0 - 0 - 0 |
| | pile end 3: | 0 - 0 - 0 |
| | pile end 4: | 0 - B - B |
| Lift plan 30: | pile end 1: | B - B - 0 |
| | pile end 2: | 0 - 0 - 0 |
| | pile end 3: | B - 0 - 0 |
| | pile end 4: | B - 0 - B |
| Lift plan 31: | pile end 1: | B - 0 - B |
| | pile end 2: | 0 - B - 0 |
| | pile end 3: | 0 - B - 0 |
| | pile end 4: | B - B - 0 |
| Lift plan 32: | pile end 1: | B - B - 0 |
| | pile end 2: | 0 - 0 - B |
| | pile end 3: | 0 - 0 - B |
| | pile end 4: | B - B - B |
| Lift plan 33: | pile end 1: | B - 0 - B |
| | pile end 2: | B - B - B |
| | pile end 3: | 0 - 0 - 0 |
| | pile end 4: | 0 - B - B |
| Lift plan 34: | pile end 1: | 0 - B - 0 |
| | pile end 2: | B - 0 - B |
| | pile end 3: | B - 0 - 0 |
| | pile end 4: | B - 0 - B |
| Lift plan 35: | pile end 1: | B - 0 - B |
| | pile end 2: | B - B - 0 |
| | pile end 3: | 0 - B - 0 |
| | pile end 4: | B - B - 0 |
| Lift plan 36: | pile end 1: | B - B - 0 |
| | pile end 2: | 0 - B - B |
| | pile end 3: | 0 - 0 - B |
| | pile end 4: | B - B - B |

4. Method according to claim 3 characterized in that: with a backing fabric repeat over four picks, the successive working repeats for the pile warp ends which are indicated by A, B, C and D are repeated depending on the location of the three picks in upper and lower fabrics, and that If no figure forming pile end appears in the working repeat,
lift plan 1 is used for backing fabric repeat A
lift plan 2 is used for backing fabric repeat B
lift plan 3 is used for backing fabric repeat C
lift plan 4 is used for backing fabric repeat D If a figure forming pile end appears in the working repeat whereby this is belonging to the ones to be woven-in in the lower fabric and is not pattern forming in the preceding repeat,
lift plan 5 is used for backing fabric repeat A
lift plan 6 is used for backing fabric repeat B
lift plan 7 is used for backing fabric repeat C
lift plan 8 is used for backing fabric repeat D If a pattern forming pile end appears in the working repeat whereby this is belonging to the ones to be woven-in in the lower fabric and this same pile end formed pattern in the preceding repeat,
lift plan 9 is used for backing fabric repeat A
lift plan 10 is used for backing fabric repeat B
lift plan 11 is used for backing fabric repeat C
lift plan 12 is used for backing fabric repeat D If a pattern forming pile end appears in the working repeat whereby this is belonging to the ones to be woven-in in the lower fabric and in the preceding repeat a pile end is pattern forming which is belonging to the ones to be woven-in in the lower fabric,
lift plan 13 is used for backing fabric repeat A
lift plan 14 is used for backing fabric repeat B
lift plan 15 is used for backing fabric repeat C
lift plan 16 is used for backing fabric repeat D If a pattern forming pile end appears in the working repeat whereby this is belonging to the ones to be woven-in in the lower fabric and in the preceding repeat a pile end is pattern forming which is belonging to the ones to be woven-in in the upper fabric,
lift plan 17 is used for backing fabric repeat A
lift plan 18 is used for backing fabric repeat B
lift plan 19 is used for backing fabric repeat C
lift plan 20 is used for backing fabric repeat D If a pattern forming pile end appears in the working repeat whereby this is belonging to the ones to be woven-in in the upper fabric and in the preceding repeat no pile end is pattern forming,
lift plan 21 is used for backing fabric repeat A
lift plan 22 is used for backing fabric repeat B
lift plan 23 is used for backing fabric repeat C
lift plan 24 is used for backing fabric repeat D If a pattern forming pile end appears in the working repeat whereby this is belonging to the ones to be woven-in in the upper fabric and in the preceding repeat the same pile end is pattern forming,
lift plan 25 is used for backing fabric repeat A
lift plan 26 is used for backing fabric repeat B
lift plan 27 is used for backing fabric repeat C
lift plan 28 is used for backing fabric repeat D If a pattern forming pile end appears in the working repeat whereby this is belonging to the ones to be woven-in in the upper fabric and in the preceding repeat a pile end is patterns forming which is belonging to the ones to be woven-in in the lower fabric,
lift plan 29 is used for backing fabric repeat A
lift plan 30 is used for backing fabric repeat B
lift plan 31 is used for backing fabric repeat C
lift plan 32 is used for backing fabric repeat D If a pattern forming pile end appears in the working repeat whereby this is belonging to the ones to be woven-in in the upper fabric and in the preceding repeat another pile end is pattern forming which is belonging to the ones to be woven-in in the upper fabric,
lift plan 33 is used for backing fabric repeat A
lift plan 34 is used for backing fabric repeat B
lift plan 35 is used for backing fabric repeat C
lift plan 36 is used for backing fabric repeat D Whereby the backing fabric repeats A, B, C, D differ from each other in the picks sequence, by the location of the weft ends in relation to the pile warp ends, above (B) or below (0) the pile warp ends of the upper fabric (BW) or of the lower fabric (OW) in the following manner:

repeat A: B/BW—B/OW—O/BW

B: O/OW—B/BW—B/OW

C: O/BW—O/OW—B/BW

D: B/OW—O/BW—O/OW

5. Method for weaving a face-to-face pile fabric, according to claim 3 characterized in that:

If lift plan 17 is directly followed by lift plan 30, and whereby pile end 2 with lift plan 17 is physically the same pile end as pile end 1 with lift plan 30, then with lift plan 17 the positions of pile end 2 are changed into B—B—0;

If lift plan 20 is directly followed by lift plan 29, and whereby pile end 2 with lift plan 20 is physically the same pile end as pile end 1 with lift plan 29, then with lift plan 20 the positions of pile end 2 are changed into B—0—B;

If lift plan 29 is directly followed by lift plan 18, and whereby pile end 2 with lift plan 29 is physically the same pile end as pile end 1 with lift plan 18, then with lift plan 29 the positions of pile end 2 are changed into 0—B—0;

If lift plan 30 is directly followed by lift plan 19, and whereby pile end 2 with lift plan 30 is physically the same pile end as pile end 1 with lift plan 19, then with lift plan 30 the positions of pile end 2 are changed into 0—0—B.

6. Method according to claim 1, characterized in that with weaving with a double rapier weaving machine, in order to obtain a one shot-weave every second pick is omitted in the upper fabric and lower fabric.

7. Face-to-face woven pile fabric manufactured according to a method according to claim 1.

8. Method for weaving of a face-to-face pile fabric in a one shot-weave, for making up a lift plan which with each of plural picks determines a position of a pile warp end, of which the pile configuration corresponds to a predetermined pointed-paper drawing and reappears alternately in a predetermined periodical repeat is compiled in the following steps:

a) starting at a specific pick, successive picks are further divided into groups of three, and commencing with an initial index, with an increasing increment, they are provided until first repeat is repeated and whereby the initial index is again restarted, three groups of three picks differ from each other over a number of repeats from the initial repeat with regard to the location of three weft ends above or below at least the multiple tight warp ends and woven-in pile ends of the upper and lower fabric;

b) For each working repeat of the different working repeats occurring, a number of possible lift plans are arranged for the positions of the pile ends in each working repeat;

c) With the conversion of the pointed-paper drawing into lift plans, per row at each point of card drawing a lift plan is in each case assigned over three picks by differentiation of the working repeat in question and by choice of the correct lift plan for this point from a number of lift plans for this working repeat.

9. Method according to claim 8 characterized in that in step b, several lift plans are arranged for every pile configuration in a working repeat corresponding to the combinations of every pile end configuration with pile end configurations from an immediately preceding working repeat, with then in step c) that lift plan is chosen which is adapted to the combination of the momentary pile end configuration with the immediately preceding pile end configuration.

10. Method according to claim 8 characterized in that when a non-pattern forming pile end in the upper or lower fabric over two working repeats always floats on the outside backings in relation to the face-to-face fabrics as considered together of the three weft ends of these two working repeats for upper or lower fabric, the lift plan is so modified on the middle pick of the retained working repeat that the non-pattern forming pile end is woven-in at a middle pick of the backing fabric.

11. Face-to-face pile fabric obtained with the assistance of a lift plan made up according to claim 8.

* * * * *